US006394179B1

(12) United States Patent
Blomgren et al.

(10) Patent No.: US 6,394,179 B1
(45) Date of Patent: May 28, 2002

(54) PLATE HEAT EXCHANGER

(75) Inventors: Ralf Blomgren, Skanor; Mats Nilsson, Lund, both of (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/936,249

(22) PCT Filed: Feb. 22, 2000

(86) PCT No.: PCT/SE00/00354

§ 371 (c)(1),
(2), (4) Date: Sep. 7, 2001

(87) PCT Pub. No.: WO00/53989

PCT Pub. Date: Sep. 14, 2000

(30) Foreign Application Priority Data

Mar. 9, 1999 (SE) ..... 9900855

(51) Int. Cl.[7] ..... F28F 3/08
(52) U.S. Cl. ..... 165/167; 165/DIG. 372
(58) Field of Search ..... 165/165, 166, 165/167, 170, DIG. 372, DIG. 384, 153; 123/196 AB, 41.33

(56) References Cited

U.S. PATENT DOCUMENTS

| | | | | | |
|---|---|---|---|---|---|
| 3,590,917 | A | * | 7/1971 | Huber et al. | 165/167 |
| 5,327,958 | A | * | 7/1994 | Machata et al. | 165/166 |
| 5,638,899 | A | * | 6/1997 | Blomgren et al. | 165/166 |
| 5,913,361 | A | * | 6/1999 | Engstrom et al. | 165/167 |
| 5,924,484 | A | * | 7/1999 | Andersson et al. | 165/167 |
| 5,971,065 | A | * | 10/1999 | Bertilson et al. | 165/167 |

FOREIGN PATENT DOCUMENTS

| | | |
|---|---|---|
| EP | 551 545 | 7/1993 |

* cited by examiner

*Primary Examiner*—Henry Bennett
*Assistant Examiner*—Terrell McKinnon
(74) *Attorney, Agent, or Firm*—Fish & Richardson P.C.

(57) ABSTRACT

Corrugated heat exchanger plates (2) of a plate heat exchanger have outer edges of a similar design. A first set of the heat exchanger plates are brazed together in their outer edges and around at least two port holes, as well as, preferably, at all of the points upon the heat exchanger plates where the corrugations bear on each other. Another set of heat exchanger plates are brazed together in their outer edges and around at least two port holes only.

7 Claims, 1 Drawing Sheet

PLATE HEAT EXCHANGER

FIELD OF THE INVENTION

The present invention concerns a plate heat exchanger for at least two heat exchanging fluids which heat exchanger is permanently joined and comprises at least one core of plates with a plurality of heat exchanging plates and at least two end plates, the heat exchanging plates creating plate interspaces between each other.

BACKGROUND OF THE INVENTION

EP, A1, 0 551 545 shows an oil cooler without a housing. Heat exchanging plates are on one side covered with a sacrificial corrosion layer 73 and on the other side covered with a solder material 75 for brazing, see for example FIG. 8. The plates are turned in such a way in the core of plates that every other plate interspace, which is aimed for water that is cooling, shows heat exchanging plate areas with a sacrificial corrosion layer only while the rest of the plate interspaces, aimed for the oil to be cooled, shows heat exchanging plate areas with layers of solder material only. In this way the risk of corrosion in the plate interspaces with water is reduced at the same time as these plate interspaces show a minimum amount of solder material. In order to be able to braze the core of plates together however one has been forced to modify the visual appearance of the edges for half the number of plates. Such modifications are expensive.

SUMMARY OF THE INVENTION

The purpose of the invention is to create an inexpensive plate heat exchanger for cooling of beverages or the like in which heat exchanger a significant less amount of solder material is present in those plate interspaces where the beverage is to pass than in of the rest of the plate interspaces. The invention thus comprises a plate heat exchanger for at least two heat exchanging fluids which heat exchanger is permanently joined and comprises at least one core of plates with a plurality of heat exchanging plates and at least two end plates. The heat exchanging plates create plate interspaces between each other.

Each one of the heat exchanging plates is provided with one or several corrugations which vertically extends/extend within an area bounded by two at a distance from each other situated parallel first and second planes respectively and which both are mainly in parallel with all the heat exchanging plates as well as with the end plates of the plate heat exchanger. Each one of the heat exchanging plates is provided with at least four port holes being parts of an inlet channel and an outlet channel through the core of plates for each one of the fluids.

At least one of the end plates has a plurality of port holes each one communicating with one of the inlet channels or one of the outlet channels and the inlet channels and the outlet channels for a first and a second fluid respectively are in fluid communication with a first and a second set of plate interspaces respectively.

The heat exchanging plates have outer edges of a similar design. On each other bearing heat exchanging plates in at least each one of the plate interspaces being parts of the said first set of plate interspaces are brazed together in their outer edges, around at least two port holes as well as in preferably all of those points upon the heat exchanging plates where the respective corrugations bear on each other while on each other bearing heat exchanging plates in at least each one of the plate interspaces being parts of the said second set of plate interspaces are brazed together in their outer edges and around at least two port holes only.

The characteristics in other respects of the present invention are clear from the following patent claims.

The plate heat exchanger will now be closer described in connection with forms of execution of the invention and with reference to the accompanying drawings.

DETAILED DESCRIPTION

Figure 1:
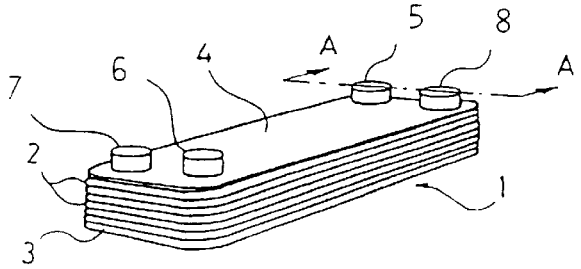
FIG. 1 shows, in a perspective view, a plate heat exchanger according to the invention.

The plate heat exchanger 1 in FIG. 1 comprises a core of heat exchanging plates 2 and end plates 3, 4. Connections 5, 6, 7, 8 for two heat exchanging fluids are present. In the mode of execution shown here the connections 5 and 6 constitute inlets for a first heat exchanging fluid and a second heat exchanging fluid respectively while the connections 7 and 8 constitute outlets for the said first and second heat exchanging fluids respectively.

Figure 2:
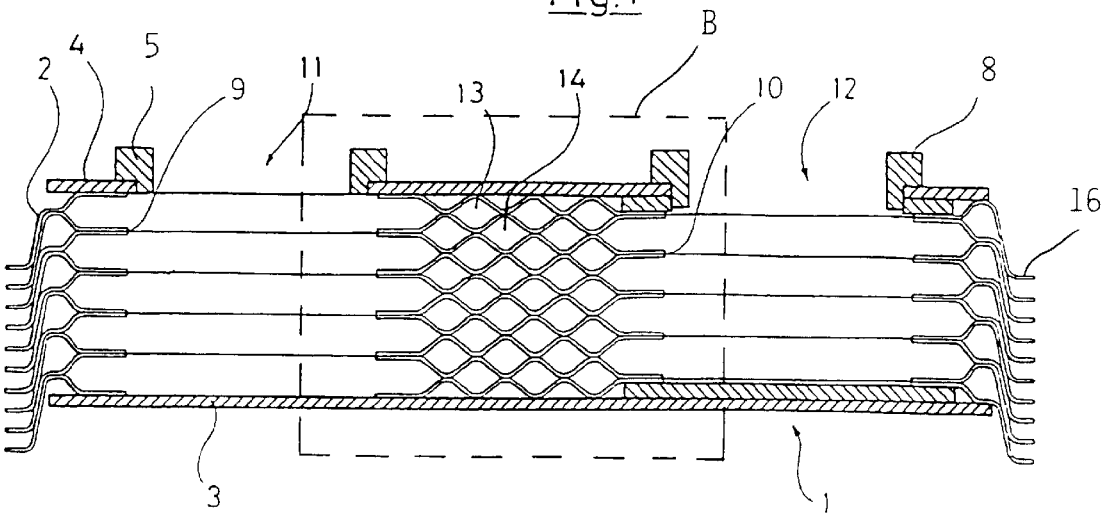
FIG. 2 shows, a cross-section through the plate heat exchanger along the line A—A in FIG. 1.

From the cross-section in FIG. 2 it is evident how port holes 9, 10 in every heat exchanging plate 2 create two port channels 11, 12 through the core of plates in one of its ends. The corresponding relationships are present in the other end of the core of plates. In the mode of execution shown here the port channel 11 constitutes an inlet channel for the first heat exchanging fluid while the port channel 12 constitutes an outlet channel for the second heat exchanging fluid. Thus a supplementary inlet channel for the second heat exchanging fluid and an outlet channel for the first heat exchanging fluid exist in the second end of the core of plates (the nearer end of the core of plates in FIG. 1). The inlet channel and the outlet channel for the first heat exchanging fluid are in fluid communication with a first set of plate interspaces 13 while the inlet channel and the outlet channel for the second heat exchanging fluid are in fluid communication with a second set of plate interspaces 14.

Figure 3:
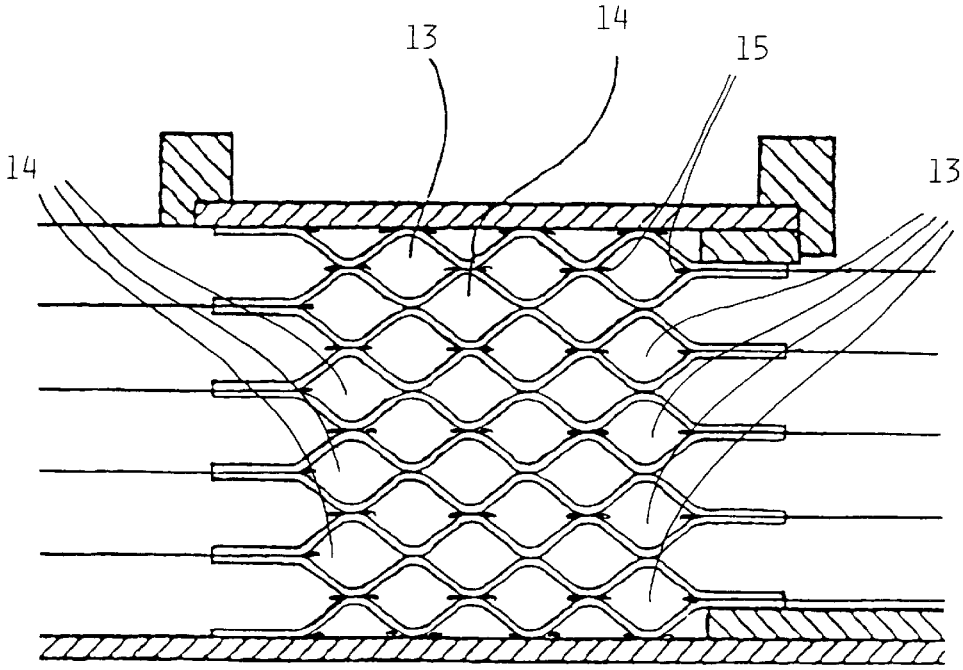
FIG. 3 shows an enlarged cross-section through that part of the plate heat exchanger in FIG. 2 marked B.

The plate heat exchanger is permanently joined by brazing or the like. From FIG. 3 it is evident how the said first set of plate interspaces 13 shows soldering seams 15 in a conventional way in the present connection, i.e. soldering seams are present in every point where adjacent plates bear on each other in the core of plates. The said second set of plate interspaces 14 however show significantly fewer soldering seams 15 in such a way that soldering seams, apart from around the outer edges of the heat exchanging plates, are present around those port holes that are creating the port channels transporting the first heat exchanging fluid only. The second set of plate interspaces 14 thus does not show any soldering seams in those points where corrugations upon adjacent plates bear on each other.

The end plates 3, 4 are attached to the respective outer heat exchanging plate 2 with soldering seams 15 in an ordinary way. Each one of the heat exchanging plates 2 is made with a flangelike edge 16 running along the whole circumference of the plate which edge makes an angle with the main plane of extension of the plate and which bears on the corresponding edges on the adjacent heat exchanging plates 2 in the core of plates.

For the construction of the core of plates heat exchanging plates 2 are piled with intervening soldering material in such a way that one or several foils of soldering material are placed between plates which are going to create plate interspaces being parts of the first set of plate interspaces which foils together cover the larger part of or most preferably the whole area of a plate, while between those plates that are to create the plate interspaces being parts of the second set of plate interspaces a suitable soldering suspension (flowing in emulsion) is coated around the outer edges of the plates as well as around the port holes that are to be sealed against the fluid which is not to be present in the present plate interspace.

As an alternative it is of course possible to apply a suitable soldering suspension to the larger part of or most preferably the whole area of a plate between plates that are to create plate interspaces being parts of the first set of plate interspaces and/or to place one or several foils of soldering material between plates that are to create plate interspaces being parts of the second set of plate interspaces around the outer edges of the plates as well as around the port holes that are to be sealed against the fluid which is not to be present in the present plate interspace. Also a paste may be used instead of a foil.

Even if one usually works plate for plate when building up the core of plates it is quite possible to save the application of the soldering material until the core of plates has been finally piled and the application of the solder material is then suitably done by pencilling with a soldering suspension considering all the outer edges and/or port holes in the plates. The soldering material applied afterwards in this way is sucked in place by capillary effects when the core of plates is thereafter placed in an oven in a usual way for the brazing together.

When beverages or demineralized water is to be treated, for example cooled, in the finished plate heat exchanger a nickel based solder is suitably used, but also a copper based soldering material or any other soldering material which works in the form of a foil, a paste or a suspension in connection with the brazing together in an oven is thinkable.

When using the heat exchanger the delicate beverage, for example beer to be cooled, or the like is entered through the inlet 6 and flows further out into the plate interspaces being parts of the second set. Since these plate interspaces contain a significant lower amount of soldering material since the present brazing points are so much fewer than what is the case for the other plate interspaces, the risk of the metal ions from the soldering material wandering out into the liquid and, giving rise to unwanted taste effects or the like is minimized. The delicate beverage or the like then leaves the heat exchanger through the outlet channel 12 and the outlet 8. The fluid which is heat treating, for example the water that is cooling, is in turn entered through the inlet 5 and the inlet channel 11 and flows further out into the plate interspaces being parts of the first set of plate interspaces in order to leave the heat exchanger through the outlet 7.

Plate interspaces being parts of the second set of plate interspaces are of course not that pressure resisting as plate interspaces being parts of the first set of plate interspaces. Therefore it is suitable to design the plate heat exchanger in a way according to the FIGS. 2 and 3 in the respect that totally brazed plate interspaces, i.e. plate interspaces normally being parts of the first set of plate interspaces, are allowed to exist closest to the respective end plate in both ends of the core of plates. If this is not enough to create the accurate pressure resistance the construction may be further strengthened by letting two or more totally brazed plate interspaces occur closest to the respective end plate in both ends of the core of plates and this without the occurrence of plate interspaces which are only brazed in their edges or in any other way only partly brazed between these "outer" totally brazed interspaces in each one of the ends of the core of plates.

When several "outer" totally brazed interspaces after each other in this way are used closest to the respective end plate in both ends of the core of plates it will normally not have to flow any heat exchanging fluid, for example water that is cooling, in more than one of these in each end of the core of plates and then suitably in those plate interspaces which are next to plate interspaces containing beverage or the like which is to be cooled. One or several plate interspaces next to each other in each end of the core of plates may thus be empty, i.e. not contain any heat exchanging fluid, when using the plate heat exchanger and this may be accomplished by suitable blockages between the present inlet and outlet channels on one hand and the present plate interspaces on the other hand.

It is further possible to let a few plate interspaces that are parts of the second set of plate interspaces, aimed for delicate beverage or the like comprise more brazing points than the rest of the plate interspaces of the same kind. For example contact points between plates in a narrower or broader strip over the corrugated heat exchanging areas of the plates may be brazed together. These "special" interspaces for beverage or the like may then be placed at any place in the core of plates, for example in the middle of this or in the outer edges of the core inside, between or outside the present "outer" totally brazed plate interspaces mentioned above.

The plates are often made of steel plate, but also other materials may be used like for example titanium. The heat exchanging plates 2 are often thin and the end plates 3, 4 are thick but also other modes of execution may exist. For example it is possible to think of the end plates 3, 4 not being thick and not looking like those in the figures but instead being of an appearance totally in accordance with the present heat exchanging plates 2 with the difference that port holes only are present where the mounting of connections are desired. It is also possible to use end plates 3, 4 of different designs in different ends of the present core of plates or even more end plates 3, 4 of the same appearance or different appearances in each one of the ends of the present core of plates.

The described plate heat exchanger is non expensive to produce in that all the heat exchanging plates have been given a uniform appearance in the edges and in that the amount of soldering material used being minimized. When using the heat exchanger the environmental influence on the treated fluid is minimized since it is exposed to a minimum contact with soldering material in connection with heating or cooling.

The invention is not restricted to the forms of execution shown here but may be varied in accordance with the following patent claims.

What is claimed is:

1. A plate heat exchanger for at least two heat exchanging fluids, said heat exchanger being permanently joined and comprising at least one core of plates having a plurality of heat exchanging plates (2) and at least two end plates (3, 4), the heat exchanging plates (2) creating between one another plate interspaces, wherein each one of the heat exchanging plates (2) is provided with at least one vertically extending corrugation within an area bounded by two opposing parallel first and second plates, respectively, said first and second plates being mainly in parallel with all the other heat exchanging plates (2) as well as the end plates (3, 4) of the plate heat exchanger, each one of the heat exchanging plates (2) being provided with at least four port holes (9, 10), said holes being parts of an inlet channel (11) and an outlet channel (12) through the core of plates for each one of the fluids, at least one of the end plates (3, 4) having a plurality of port holes, each one of said port holes communicating with one of the inlet channels (11) or one of the outlet channels (12) and the inlet channels (11) and the outlet channels (12) for a first and a second fluid, respectively, are in fluid communication with a first (13) and a second (14) set of plate interspaces, respectively, and further wherein the heat exchanging plates (2) have outer edges having a similar design to one another and on each other bearing heat exchanging plates (2) in at least each one of the plate interspaces being parts of the said first set of plate interspaces (13) are brazed together in their outer edges, and around at least two port holes (9) and in preferably all of those points upon the heat exchanging plates (2) where the respective corrugations bear on each other, while on each other bearing heat exchanging plates (2) in substantially all of the plate interspaces being part of the said second set of plate interspaces (14) are brazed together in their outer edges and around at least two port holes (10) only.

2. A plate heat exchanger according to claim 1, wherein each one of the heat exchanging plates (2) is made with a flangelike edge (16) running along the whole circumference of the plate, said edge making an angle with the main plane of extension of the plate and bearing on the corresponding edges on the adjacent heat exchanging plates (2) in the present core of plates.

3. A plate heat exchanger according to claim 1, wherein two heat exchanging plates (2), together creating a plate interspace being part of said first set of plate interspaces (13), are present closest to the respective end plates (3, 4) in both ends of the present core of plates.

4. A plate heat exchanger according to claim 1, wherein at least three heat exchanging plates (2), together creating at least two plate interspaces being parts of said first set of plate interspaces (13), without intermediate plate interspaces being parts of said second set of plate interspaces (14), are present closest to the respective end plate (3, 4) in both ends of the present core of plates.

5. A plate heat exchanger according to claim 1, wherein at least three heat exchanging plates (2), together creating at least two plate interspaces situated closest to the respective end plate (3, 4) in both ends of the present core of plates, are provided with blockages in such a way that the plate interspaces in question are not in fluid communication with any inlet channel (11) or outlet channel (12) at the same time as the plate interspaces in question have soldering seams in the outer edges of the heat exchanging plates (2), around at least two port holes (9, 10) as well as in preferably all of those points where corrugations upon adjacent heat exchanging plates (2) bear on each other.

6. A plate heat exchanger according to claim 1, wherein the brazing is executed with a nickel-based solder.

7. A plate heat exchanger according to claim 1, wherein the brazing is executed with a copper-based solder.

* * * * *